US005145076A

United States Patent [19]

Murphy et al.

[11] Patent Number: 5,145,076

[45] Date of Patent: Sep. 8, 1992

[54] PLASTIC KNUCKLE PIN WITH ANNULAR RELIEF GROOVES FOR PREVENTING PIN FAILURE DUE TO FATIGUE

[75] Inventors: Richard F. Murphy, Batavia; Michael K. Burke, Wheaton, both of Ill.

[73] Assignee: Zeftek, Inc., Batavia, Ill.

[21] Appl. No.: 612,310

[22] Filed: Nov. 13, 1990

[51] Int. Cl.[5] ..... B61G 3/04

[52] U.S. Cl. ..... 213/155; 213/156; 384/624; 16/386

[58] Field of Search ..... 213/152, 155, 156; 384/624, 396; 16/273, 380, 381, 385, 386

[56] References Cited

U.S. PATENT DOCUMENTS

| | | | |
|---|---|---|---|
| 1,857,035 | 5/1932 | Tomlinson | 213/152 |
| 2,857,057 | 10/1958 | Metzge | 213/155 |
| 3,546,735 | 3/1967 | Liautaud | 16/385 X |
| 4,345,848 | 8/1982 | Cheselka | 16/385 X |
| 4,440,586 | 11/1890 | Eastwick, Jr. | 213/155 |
| 4,640,422 | 2/1987 | Elliott | 213/155 |
| 4,976,363 | 12/1990 | Altherr | 213/155 |

OTHER PUBLICATIONS

McConway & Torley publication, "The M&T Straight Pin Hole Coupler Knuckle", Jan. 9, 1989.

Association of American Railroads (AAR) Specification M-118-61, Jan. 9, 1989.

*Primary Examiner*—Robert J. Oberleitner
*Assistant Examiner*—S. Joseph Morano
*Attorney, Agent, or Firm*—Lloyd L. Zickert

[57] ABSTRACT

A plastic knuckle pin for a coupler on a railway car which accepts bending fatigue, eliminates rust or corrosion, and reduces the coefficient of friction during opening and closing the coupler. The pin also protects the integrity of the coupler body and the knuckle to reduce coupler maintenance and further reduces the weight of the railway car and facilitates the use of a self-locking feature.

11 Claims, 3 Drawing Sheets

FIG. 3
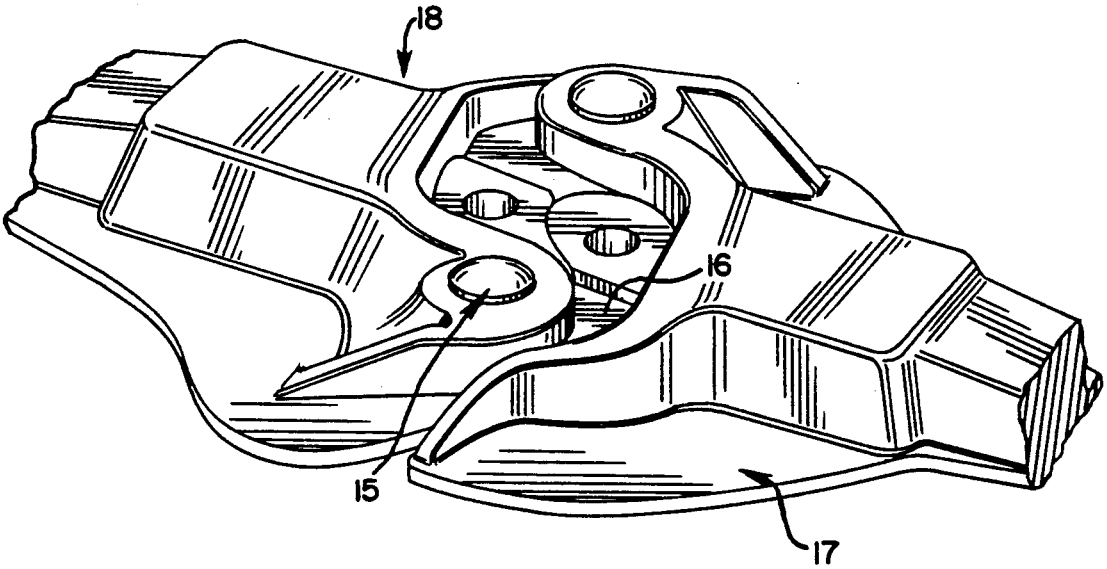
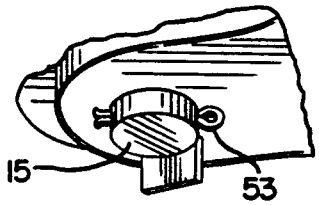
FIG. 4
FIG. 5
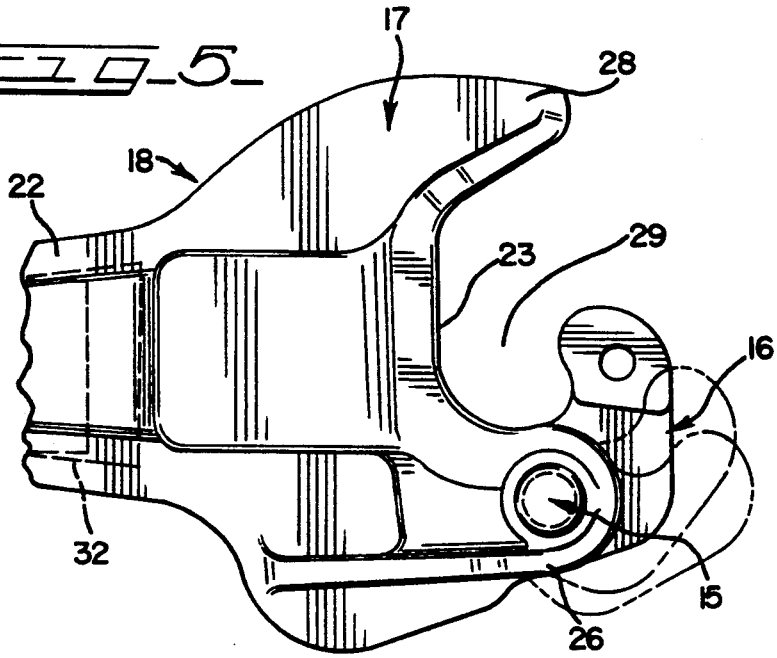

PLASTIC KNUCKLE PIN WITH ANNULAR RELIEF GROOVES FOR PREVENTING PIN FAILURE DUE TO FATIGUE

DESCRIPTION

This invention relates in general to a new and improved knuckle pin for couplers on railway cars, and more particularly to a knuckle pin made of a flexible self-lubricating plastic material that enhances the life of the coupler and reduces coupler maintenance costs, and still more particularly to a new and improved plastic knuckle pin that enhances the safety of coupler maintenance workers.

BACKGROUND OF THE INVENTION

Recently, the railroad industry has shown a high degree of awareness to the problem of missing or broken knuckle pins. They have also given consideration to the cause of failure and any impact the pin may have on causing failure of other coupler parts. The overall results from gathering information and test data lead to the conclusion that pin failure is caused by bending fatigue. Technically, knuckle pins are not to be subjected to bending fatigue inasmuch as the coupler body and knuckle are designed to take the loading resulting from buff and draft forces. Thus, the pins are not designed to take any load. Their design purpose is solely to function as a pivot connection between the knuckle and the coupler body when opening or closing the knuckle. Due to an inability to control dimensional tolerances during casting procedures with common foundry practice of the coupler body and knuckle, the knuckle pin is often subjected to load in both buff and draft actions, thereby resulting in failure due to bending fatigue.

Heretofore, it has been well known to use a steel knuckle pin in coupler assemblies for defining the hinging of the knuckle to the coupler body. It also has been known that this steel pin causes maintenance and operational difficulties such that investigations and studies have been made by the American Association of Railroads. It has caused concern for seeking a solution to pin failure which could lead to derailments and a solution to reducing overall coupler maintenance.

The heretofore known steel pin is susceptible to rust and corrosion problems. Because the pins are sometimes of harder steel than the coupler body and/or knuckle, damage is produced in the coupler body or knuckle requiring replacement of either or both. Although the coupler assembly is constructed with the purpose in mind that the knuckle pin is not subjected to any stress during its use, it is well known that the tolerance of the coupler body and knuckle is such that bending stresses most often are transmitted to the knuckle pin during draft (tension) and buff (compression) of the railway cars.

Failure of a knuckle pin may often go undetected by an inspector because the lower portion of the pin is not readily observable unless the inspector takes time to bend down and inspect the underside of the couplers. Thus, fracture of a pin and the dropping of the lower end of the pin out of the coupler assembly may go unnoticed. This thereafter could cause a coupler failure that could even lead to a serious derailment or other accident. Further, in hopper cars that must be turned over for dumping, fractured or broken pins may fall out of the coupler assembly and enter the crusher, thereby causing damage to the crusher parts. Thus, magnets have been installed in crushers in order to prevent pin segments from going into the crusher. These magnet systems are costly and not totally effective.

While it is desirable to have a steel pin rotate during its use in order to enhance the life of the pin, once a steel pin is bent it cannot thereafter be rotated. A bent pin causes binding between knuckle and coupler body, thereby impeding coupler operations. Further, on open-top hoppers and fixed-end gondolas, the required application of a cotter pin prohibits rotation of the pin. Also, bending fatigue caused by draft and buff operations is the common cause of failure of steel pins. Where pin failures occur in service, such could result in separation of the knuckle from the coupler body which causes undesired emergency stops and possible derailments.

Failure of steel pins is also caused by work-hardening of the pin after it has been bent and kept from free rotation. Some manufacturing difficulties can occur where there is a significant hardness gradient across the diameter of the pin which may have been the result of improper heat treatment procedures.

It is also known that with respect to use of steel pins, since it cannot be determined whether it is broken and where the broken parts are in the coupler assembly, upon opening of the knuckle, the 70 to 80 pound knuckle could fall from the coupler assembly and injure a maintenance worker's foot. Thus, safety of maintenance workers is jeopardized by the use of steel knuckle pins.

It is well known that knuckles were constructed with a hollow area within the body of the knuckle around the knuckle pin hole. One previously known attempt to overcome pin failure was in the design of a straight-through hole in the knuckle and which did produce some favorable effect on the reduction of knuckle pin failures. It has also been proposed to reduce the tolerances for making of coupler bodies and knuckles, but that has not been found to be practical. It has further been proposed to bond a plastic or rubber sleeve to the pin surface to allow the sleeve to deflect easier in the regions of highest stress, but no product of this type has ever been made.

SUMMARY OF THE INVENTION

The present invention is in a plastic knuckle pin that will accept bending fatigue, thereby reducing pin failure. The pin of the present invention is made of a plastic material having a flexibility that will allow it to bend and return to its original shape and to also be self-lubricating. Further, the pin of the present invention eliminates rust and corrosion and produces a low coefficient of friction between the pin and the coupler body and knuckle, thus enhancing opening and closing of the knuckle by reducing rotational resistance, thereby promoting safety. It has been known that steel pins, either at the time of installation or after service, can cause a "lazy knuckle", i.e., a knuckle that will not open all the way on decoupling. Thereafter, it is usually impossible for the knuckle to close in a coupling operation which necessitates a yard worker to reach in with his hand and pull the knuckle into fully open position, and usually when another car is coming to couple. While it is against the rules to pull open a knuckle under those circumstances, the worker often tries, which many times has resulted in the worker's hand and/or arm being injured and even taken off.

Further, the pin of the invention provides protection to the eyeholes or pivot lugs of the coupler body and the knuckle by eliminating pressure on the eyeholes. The heretofore known steel pin could cause pressure on the eyeholes, resulting in cracking and breaking of the eyeholes which requires replacement of the coupler body.

It will be appreciated that the cost of the coupler body is the largest of the coupler assembly and in the range of $500, while the cost of a knuckle is in the range of $80, and the cost of a knuckle pin is in the range of $6. Thus, it is important to protect the coupler body against damage.

Heretofore used steel knuckle pins weigh about eight pounds, while the plastic knuckle pin of the present invention weighs about one pound. Inasmuch as two pins are used on each car, the present invention reduces the weight of the car by about fourteen pounds. Moreover, the substantially lower weight of the pin allows a maintenance worker to carry five or six replacement pins during the inspection of a train as opposed to carrying metal pins that are seven times heavier.

The plastic knuckle pin of the invention is made of a plastic material such as a high molecular weight polyethylene or a urethane which has a flexibility or resiliency that allows it to be bent and returned to its original form without fracturing. The flexibility also permits transfer of the load during draft from the pin and front of the eyeholes directly to the pulling lugs where dimensional variances are present that would otherwise load a steel pin. It is known that use of steel pins in couplers causes the pin and pivot lugs and the pin bosses at the lugs to carry a portion of the service load which by design was originally intended to be borne only by the pulling lugs. Current loading of a knuckle pin which is unintended results in continually bending back and forth of the pin caused by the train in buff and draft operation. This leads to metal fatigue in the pin and/or eyehole bosses that results in failure.

With respect to rotary dumpers for unloading of coal, should the plastic pin or part of the pin of the present invention go into the crusher or conveyer, it will not pose any adverse problems such as when a steel pin or segment goes into the crusher.

A modification of the plastic pin of the present invention reduces the outer diameter at the areas where stress would normally be produced and where the eyeholes and knuckle are in adjacent relation to reduce the application of stress to the pin. Another modification of the pin is to provide a self-locking feature that eliminates a need to use a cotter pin or other fastener for maintaining the pin in place.

It has been determined after substantial testing of the plastic knuckle pin of the present invention that maintenance and repairs of couplers is greatly enhanced. The knuckle pin of the invention, while first felt to be helpful only in reducing weight and corrosion, has been found to unexpectedly yield to bending pressures thereby protecting the coupler body and particularly the pivot lugs or bosses from damage. Additionally, the knuckle pin of the invention allows the knuckle to open more freely, as there is less drag during coupler operations and which provides greater safety during the opening and closing operations. This overcomes the heretofore known "lazy knuckle" problem above referred to thereby promoting safety for yard workers. It should be appreciated that prior known steel pins, due to their hardness and resistance to bending pressures, have caused pivot lug or pin boss damage. While a cracked boss is acceptable for continued service, a broken boss is not, thereby requiring costly replacement of the coupler body. The cost of replacing the coupler body is not only high from the standpoint of part cost but also requires considerable labor time plus time out of service for repair.

It is therefore a primary object of the present invention to provide a plastic knuckle pin for railway car couplers which eliminates bending fatigue heretofore found in steel pins and which provides a corrosion resistant pin having a low coefficient of friction to enhance safety during opening of the knuckle and obviates the "lazy knuckle" problem.

Another object of the invention is in the provision of a knuckle pin for a coupler that is molded of a plastic material having the flexibility which overcomes bending fatigue and which enhances the life of the coupler body and knuckle.

A further object of the present invention is in the provision of a knuckle pin made of a flexible plastic which eliminates loading pressure on the top and bottom eyeholes of a coupler body and allows loading pressure to be imparted as originally designed to the pulling lugs during service of the coupler.

A still further object of the invention is in the provision of a plastic knuckle pin having a flexibility to overcome bending fatigue and which eliminates the need to change the design of the knuckle.

Another object of the invention is in the provision of a plastic knuckle pin having a flexibility to overcome bending fatigue and which when used in rotary dumpers and possibly falling out of the coupler will go through the crusher and not cause damage to the crusher.

A further object of the invention is in the provision of a new and improved knuckle pin of plastic material which is lighter in weight than metal pins, thereby reducing the overall weight of a railroad car and providing weight savings that translate into improved productivity and safety for the railroad industry.

A still further object of the invention is in the provision of a plastic knuckle pin to have the flexibility to overcome bending fatigue and which is also constructed with relief grooves at the areas where the knuckle and the eyeholes are in adjacent relation.

Another object of the invention is to provide a knuckle pin of plastic material to have such flexibility as to not be subject to bending fatigue.

A still further object of the invention is in the provision of a plastic knuckle pin which includes a self-locking feature for locking it in place on a coupler as it is installed to pivotally interconnect the knuckle and coupler body.

Other objects, features and advantages of the invention will be apparent from the following detailed disclosure, taken in conjunction with the accompanying sheets of drawings, wherein like reference numerals refer to like parts.

DESCRIPTION OF THE DRAWINGS

FIG. 3 is a top perspective view of a pair of interengaging couplers with pins shown in mounted relation with respect to the coupler bodies and knuckles;

FIG. 4 is a fragmentary bottom perspective view of one coupler to illustrate the position of the bottom end of the knuckle pin and the use of a locking cotter pin;

FIG. 5 is a top plan view of a coupler body and knuckle with the knuckle pin in place and showing the knuckle closed in solid lines and partly open and fully open in dotted lines;

DESCRIPTION OF THE INVENTION

Figure 1:
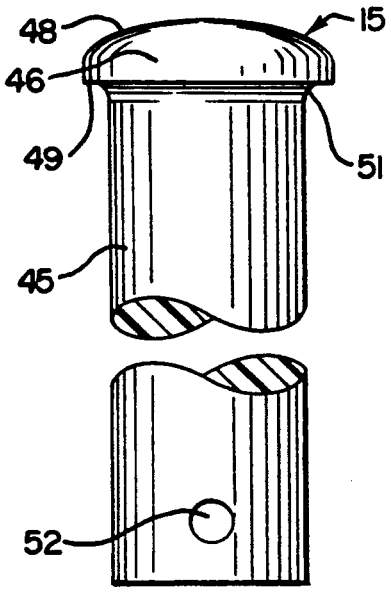
FIG. 1 is a broken elevational view of one form of plastic knuckle pin according to the present invention.
Figure 2:
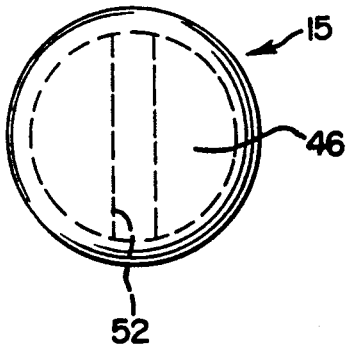
FIG. 2 is a top plan view of the knuckle pin of FIG. 1.

The usual knuckle pin of the present invention, which is used in couplers for coupling two vehicles such as railway cars, serves to pivotally interconnect the knuckle to the coupler body. The pin includes a shaft or shank having a head on one end and optionally formed at the other end to allow locking of the pin in place on a coupler. It is made of a high-strength, self-lubricating plastic material and overcomes the problems associated heretofore with steel knuckle pins. Particularly, the material used to make the pin of the invention is a plastic having a flexibility so that it can absorb bending stresses without fatigue, thereby obviating the bending fatigue problem associated with steel pin failure. Accordingly, the pin of the invention not only results in enhanced life over a steel pin but also significantly reduces maintenance and repair problems for couplers. By being made of plastic, which weighs substantially less than steel, material weight savings for the railroad cars is achieved. This reduced weight characteristic also enhances the safety of maintenance and repair workers as well as facilitating the installation of a pin on a coupler. Although persons experienced in coupler construction and maintenance as well as operation disbelieve that a plastic knuckle pin could achieve any success, testing has concluded that the plastic pin is an acceptable choice and superior in performance to a steel pin. It also materially improves the safety of workers operating the couplers.

One of the problems encountered in coupler construction is the inability to maintain close tolerances of fit between the knuckle and the coupler body because of the common foundry practice used to produce these elements. For example, one coupler may have a closely fitting knuckle and coupler body that would not encounter the problem of pin bending fatigue and failure because the pin would not be loaded during draft and buff operations. It will be understood that draft means placing the coupler under tension such as in a pulling operation, and buff places the coupler under compression such as in a pushing operation. When a coupler is subjected to draft and buff actions and the tolerances between the coupler body and knuckle are such that the pulling lugs allow load to be imparted to the knuckle pin, bending stresses are also imparted to the knuckle pin that can ultimately result in failure of the pin after many successive bending operations. It is this situation that the present invention solves by making the pin of a plastic material capable of accepting the bending stresses without failure.

Referring now to the drawings, and particularly to FIGS. 1 to 7, the knuckle pin of the invention, indicated by the numeral 15, serves to pivotally connect the knuckle 16 to the coupler body 17. Collectively, the coupler body, knuckle and knuckle pin define the coupler 18, and it will be appreciated that a coupler is located at each end of a railway car so that the railway car may be coupled at either end to another car or a locomotive. While the pin of the invention is primarily intended for use with railway car couplers, it could be used with other couplers used between road vehicles.

The coupler 18 includes a head end where the knuckle is mounted and a tail end that would be suitably secured to the railway car either in fixed relation or such that the coupler could rotate on a mounting of the car. Specifically, where cars are of the rotary dumper type, the coupler would be rotatably mounted on the car to accommodate the inversion of the car for dumping purposes. So, the coupler includes a tail 22 and extending therefrom a somewhat U-shaped head end 23. At one side of the head end, upper and lower pivot lugs or eyeholes 26 and 27 are provided with aligned openings for aligning with an opening in the knuckle and for collectively receiving the shaft or shank of the knuckle pin 15. At the other side of the head end, a projection 28 serves to coact with the pin lugs and define an opening 29 into which the head of an opposing knuckle is received when a pair of couplers are in coupling relation to each other. As seen in the schematic view of FIG. 7, upper and lower pulling lugs 32 and 33 are formed within the coupling head for purposes of coacting with the knuckle to accept draft forces imparted to the knuckle when the coupler is in draft operation.

Figure 6:
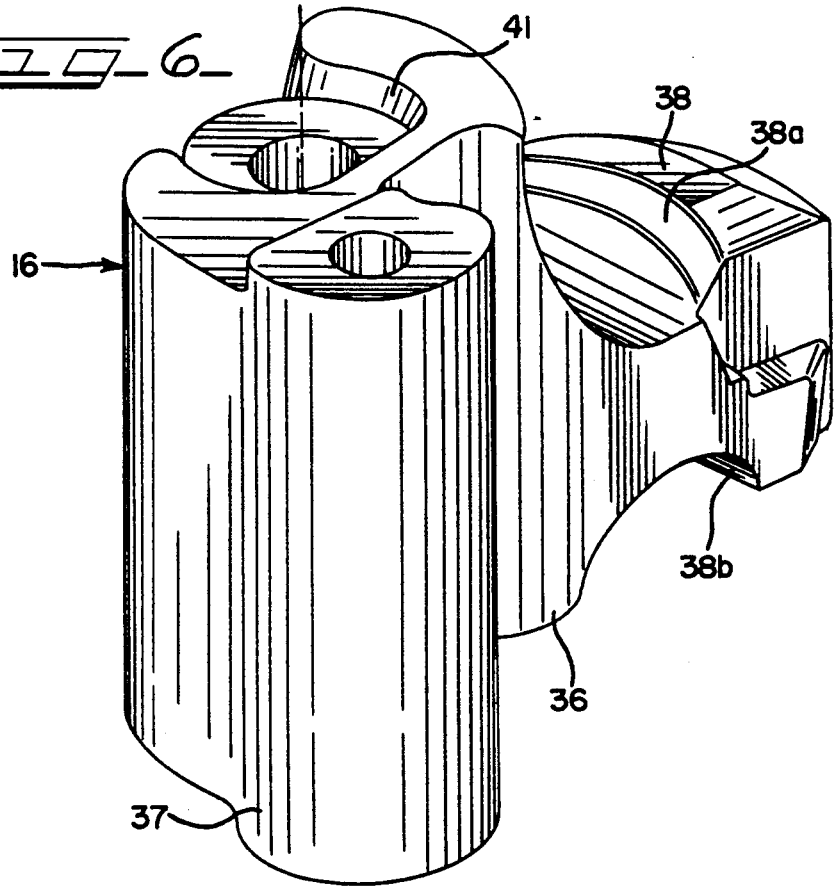
FIG. 6 is an enlarged perspective view of a knuckle used in the coupler of FIG. 3.
Figure 7:
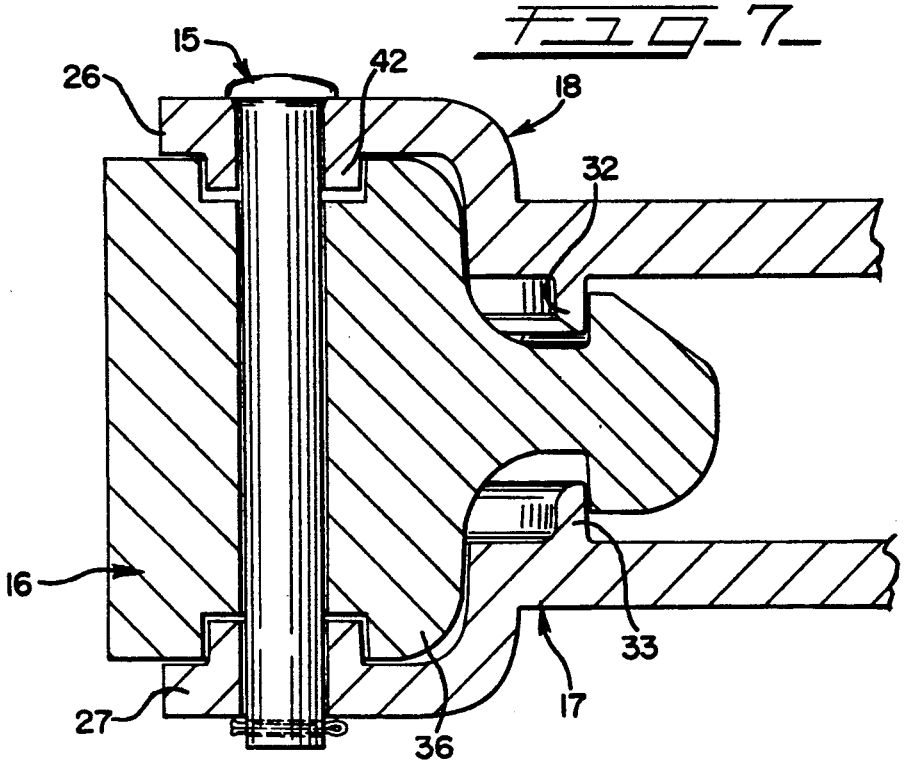
FIG. 7 is a somewhat schematic vertical sectional view taken through a coupler to illustrate the relationship between the knuckle and the pulling lugs and the knuckle and the pivot lugs.

The knuckle 16, as particularly illustrated in FIGS. 5, 6 and 7, includes a main body 36 having formed at the head end a locking arm 37 and at the tail end a pulling lug member 38 having lug-engaging faces 38*a* and 38*b* that are to coact with the pulling lugs 32 and 33 when the knuckle is in closed position and for transmitting draft forces from the knuckle to the coupler body. It is where the tolerances of the relationship between the position of the faces 38*a* and 38*b* to the pulling lugs becomes such as to cause at least some of the draft forces to be imparted to the knuckle pin such that bending stresses are imparted to the knuckle pin and which can lead to failure of a steel pin through bending fatigue.

Additionally, the knuckle 16 includes recesses at the top and bottom around the knuckle pin hole to define additional pulling lugs, such as pulling lug 41, which coact with knuckle pin bosses 42 on the inside of the pivot lugs 26 and 27. Bending action of steel knuckle pins can cause damage to these bosses which, when ascertained, require replacement of the coupler bodies. Thus, the ability of the knuckle pin of the invention to accept the bending stresses without failure enhances the life of the knuckle pin. Also, the plastic knuckle pin of the invention better protects the pin bosses on the coupler body against damage. By making the knuckle pin of the invention of a self-lubricating plastic, opening and closing of the couplers is substantially easier, thereby enhancing the safety of the workers charged with the task of operating the couplers and overcoming the above-mentioned "lazy knuckle" problem.

The knuckle pin of the invention is substantially of the same form in one version as the prior used steel pins and, as seen in FIG. 1, includes generally a shank or shaft 45 and a head 46. While the entire pin may be molded as a unitary piece, it can be appreciated that the pin may be molded of two pieces and thereafter assembled if so desired. For example, the shaft could be of extruded hollow plastic material and a head could be separately molded and thereafter suitably attached to one end of the shaft. If desired, the other end could be closed with a cap having the same diametrical dimension as the shaft. Further, it will be appreciated that the shaft will have a substantially uniform diametrical dimension throughout its length and therefore be cylindrically shaped. The head 15 includes a somewhat dome-shaped upper end 48 and sized diametrically larger than the shaft to define an annular shoulder 49. Because installation of a pin may require a driving force where the pin hole of the knuckle is not exactly aligned with the pin holes of the pin lugs, and such a driving force is usually applied by means of a mallet, which could cause damage to the head when it is seated, a reinforcing annular radius 51 is formed between the head and shaft to guard against head damage from mallet blows and to avoid sharp corners in a molded pin. In the form shown in FIG. 1, a cotter pin hole 52 is provided at the lower end for receiving a cotter pin 53, as illustrated in FIG. 4.

Figure 8:
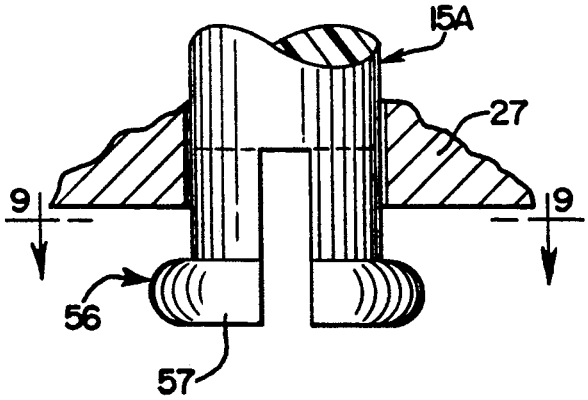
FIG. 8 is a fragmentary elevational view of the lower end of a modified knuckle pin according to the invention having a self-locking feature.
Figure 9:
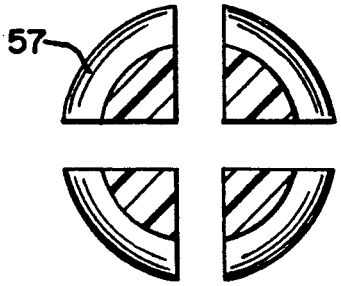
FIG. 9 is a detailed transverse sectional view taken substantially along line 9—9 of FIG. 8.

Inasmuch as the use of cotter pins sometimes impedes the ability of the pin to rotate during opening and closing operations of the coupler, and also because insertion of the cotter pin and suitable bending of the cotter pin must be made when installing and locking a pin in place, particularly where the pin goes on a rotary coupler, a self-locking device may be provided at this end such as shown in the pin 15A in FIGS. 8 and 9. The self-locking end, generally designated by the numeral 56, includes a plurality of radially enlarged flexible legs 57 which will compress together as the pin is driven through the pin openings and expand when clearing the lower pivot lug 27, thereby snapping the pin in place and locking it against withdrawal by virtue of the radially enlarged legs that interfere with any withdrawal forces by being larger than the pin opening in the lower pivot lug. Thus, it is only necessary to drive the pin through the pin openings, thereby eliminating the necessity to lock it in place with a cotter pin.

Figure 10:
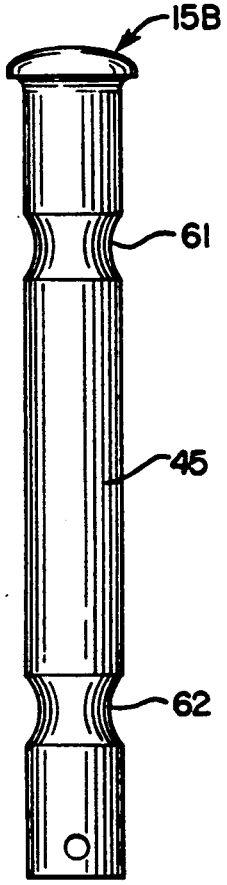
FIG. 10 is a vertical elevational view of a modified knuckle pin according to the invention.

Inasmuch as some of the couplers are made with such large tolerances, a scissors action can take place on the pin at the juncture of the pivot lugs and the knuckle. To avoid even scoring or otherwise penetrating the pin at that area, the pin is annularly relieved, as shown by the embodiment 15B in FIG. 10. Specifically, the shaft 45 is annularly relieved at 61 and 62 in order to accommodate movement of the knuckle relative to the pivot lugs without allowing a penetration of the exterior surface of the pin shaft that could lead to failure.

Suitable plastic materials for the pin of the invention include high molecular weight polyethylenes and urethanes, both of which can be injection molded. Also, both are thermoplastic materials. The polyethylene would preferably have a Shore hardness on the D scale of about 63–65, while the urethane would preferably have a Shore hardness on the D scale of about 70. A specific thermoplastic polyurethane would be Estane 58137 Compound, which is a product of B. F. Goodrich Company. (Estane is a registered trademark of B. F. Goodrich Company.) Both materials will accept the bending stresses found in railroad car couplers and, accordingly, will not fail from bending fatigue. It will be appreciated that other plastic materials having similar properties could also be used.

It is therefore seen that the above invention will provide a knuckle pin for railroad car couplers that will overcome the problems heretofore encountered with steel knuckle pins and enhance the life of the couplers.

It will be understood that modifications and variations may be effected without departing from the scope of the novel concepts of the present invention, but it is understood that this application is to be limited only by the scope of the appended claims.

The invention is hereby claimed as follows:

1. In a coupler for a railway car having a coupler body with a pair of vertically spaced apart pivot lugs with aligned openings, a knuckle with an opening extending therethrough being disposed between the lugs so that the knuckle opening aligns with the pivot lug openings, pulling lugs on the coupler body coacting with the knuckle for receiving draft forces, and a knuckle pin for pivotally connecting the knuckle to the coupler body, the improvement being in the knuckle pin which includes a shaft received in the pivot lug openings and the knuckle opening sized to allow rotation of the knuckle, a head on the top end of the shaft to prevent the pin from falling through the openings, and said pin being of a self-lubricating, high-strength, flexible plastic to absorb bending fatigue without failure resulting from the coupling being subjected to buff and draft forces.

2. The knuckle pin of claim 1, wherein a self-locking means is provided on the end of the shaft opposite from the head.

3. The knuckle pin of claim 1, wherein surface relieved portions are provided along the shaft where bending forces can be expected.

4. The coupler of claim 1, wherein the knuckle pin is injection molded of high molecular weight polyethylene.

5. The coupler of claim 1, wherein the knuckle pin is injection molded of urethane.

6. The coupler of claim 1, wherein the knuckle pin includes means at the end opposite the head for locking the pin to the coupler.

7. The coupler of claim 6, wherein the locking means includes a diametrically extending hole in the shaft and a cotter pin received in the hole.

8. The coupler of claim 6, wherein the locking means includes self-locking means functioning to lock the pin in the coupler after it is installed.

9. In a coupler for a railway car having a coupler body with a pair of vertically spaced apart pivot lugs with aligned openings, a knuckle with an opening extending therethrough being disposed between the lugs so that the knuckle opening aligns with the pivot lug openings, pulling lugs on the coupler body coacting with the knuckle for receiving draft forces, and a knuckle pin for pivotally connecting the knuckle to the coupler body, the improvement being in the knuckle pin which includes a shaft received in the pivot lug openings and the knuckle opening sized to allow rotation of the knuckle, a head on the to end of he shaft to prevent the pin from falling through the openings, annularly relieved portions along the shaft where bending forces can be expected, and sad pin being of a self-lubricating, high-strength, flexible plastic to absorb bending fatigue resulting form buff and draft forces.

10. In a coupler for a railway car having a coupler body with a pair of vertically spaced apart pivot lugs with aligned openings, a knuckle with an opening extending therethrough being disposed between the lugs so that the knuckle opening aligns with the pivot lug openings, a knuckle pin extending through the openings of the lugs and knuckle to retain the knuckle on the body and allow pivotal movement of the knuckle, pin bosses extending inward of the pivot lugs coacting with recesses in the knuckle at opposite ends of the knuckle pin opening, and pulling lugs on the coupler body coating with pulling lug members on the knuckle for transmitting draft forces from the knuckle to the coupler body when the knuckle is in closed position, the improvement being in the knuckle pin which includes a shaft received in the pivot lug openings and the knuckle opening sized to allow rotation of the knuckle, a head on the top end of the shaft to prevent the pin from falling through the openings, means at the bottom end of the pin for retaining the pin in place on the coupler, and said pin being of a self-lubricating, high-strength flexible plastic to accept bending stresses without failure and to protect the pivot lugs against damage by substantially eliminating pressure on the lugs.

11. The knuckle pin of claim 10, wherein the pin further includes annular grooves at the areas where the knuckle and the pivot lugs of the coupler body are in adjacent relation.

* * * * *